US005370840A

United States Patent [19]

Caron et al.

[11] Patent Number: 5,370,840

[45] Date of Patent: * Dec. 6, 1994

[54] COPPER ALLOY HAVING HIGH STRENGTH AND HIGH ELECTRICAL CONDUCTIVITY

[75] Inventors: Ronald N. Caron, Branford; John F. Breedis, Trumbull, both of Conn.

[73] Assignee: Olin Corporation, New Haven, Conn.

[ * ] Notice: The portion of the term of this patent subsequent to Apr. 26, 2111 has been disclaimed.

[21] Appl. No.: 135,760

[22] Filed: Oct. 18, 1993

Related U.S. Application Data

[63] Continuation-in-part of Ser. No. 971,499, Nov. 4, 1992, Pat. No. 5,306,465.

[51] Int. Cl.[5] ..... C22C 9/00

[52] U.S. Cl. ..... 420/492; 420/485; 420/487

[58] Field of Search ..... 420/492, 496, 485, 487, 420/488; 148/432, 435

[56] References Cited

U.S. PATENT DOCUMENTS

| | | |
|---|---|---|
| 2,025,662 | 12/1936 | Hensel . |
| 2,479,311 | 8/1949 | Christensen et al. . |
| 3,194,655 | 7/1965 | Pels et al. . |
| 3,392,016 | 7/1968 | Opie et al. . |
| 3,928,028 | 12/1975 | Yarwood . |
| 4,047,980 | 9/1977 | Watson et al. . |
| 4,049,426 | 9/1977 | Watson et al. . |
| 4,224,066 | 9/1980 | Watson et al. . |
| 4,589,930 | 5/1986 | Kumagal . |
| 4,594,221 | 6/1986 | Caron et al. . |
| 4,631,237 | 12/1986 | Dommer et al. . |
| 4,749,548 | 6/1988 | Akutsu et al. . |
| 4,872,048 | 10/1989 | Akutsu et al. . |
| 5,004,520 | 4/1991 | Tsuji et al. . |
| 5,017,250 | 5/1991 | Ashok . |

FOREIGN PATENT DOCUMENTS

| | | |
|---|---|---|
| 80104479 | 2/1981 | European Pat. Off. . |
| 59-193233 | 11/1984 | Japan . |
| 1157163 | 7/1969 | United Kingdom . |
| 1353430 | 5/1974 | United Kingdom . |
| 1373049 | 11/1974 | United Kingdom . |
| 1414289 | 11/1975 | United Kingdom . |
| 1525355 | 9/1978 | United Kingdom . |
| 1549107 | 7/1979 | United Kingdom . |
| 1566776 | 5/1980 | United Kingdom . |
| 2070057A | 9/1981 | United Kingdom . |
| 2259836A | 6/1985 | United Kingdom . |

OTHER PUBLICATIONS

Metals Handbook, Tenth Edition, vol. 2, (1990), pp. 259–263, 266, 281 and 290–291.

Pareige et al., "Precipitation in Dilute Cu Fe Ti Alloy: an Atom-Probe Study" appearing in Memoires et Etudes Scientifiques Revue de Metallurgie, vol. 89, No. 5, May 1992 at pp. 311–316.

Yamaguchi et al., "31 Copper–Iron–Titanium Precipitation Hardenable Dilute Alloys for Terminal and Connector Applications" appearing in Copper '90, Refining, Fabrication, Markets, Oct. 1990 at pp. 517–525.

*Primary Examiner*—Deborah Yee

*Attorney, Agent, or Firm*—Gregory S. Rosenblatt

[57] ABSTRACT

There is disclosed a copper base alloy which contains specified additions of chromium, zirconium, cobalt and/or iron, and titanium as well as methods for the processing of the copper alloy. One method of processing results in a copper alloy having high strength and high electrical conductivity. A second method of processing results in a copper alloy with even higher strength and a minimal reduction in electrical conductivity.

20 Claims, 4 Drawing Sheets

COPPER ALLOY HAVING HIGH STRENGTH AND HIGH ELECTRICAL CONDUCTIVITY

CROSS-REFERENCE TO RELATED APPLICATION

This application is a continuation in part of U.S. patent application Ser. No. 07/971,499 filed Nov. 4, 1992 , now U.S. Pat. No. 5,306,465 by Caron et al.

FIELD OF THE INVENTION

This invention relates to copper alloys having high strength and high electrical conductivity. More particularly, a copper-zirconium-chromium base alloy is modified by additions of cobalt (and/or iron) and titanium to form a copper alloy for electrical and electronic applications.

BACKGROUND OF THE INVENTION

Electrical components such as connectors and electronic components such as leadframes are manufactured from copper alloys to exploit the high electrical conductivity of copper. Pure copper such as C10200 (oxygen-free copper having a minimum copper content by weight of 99.95%) has a yield strength in a spring temper of about 37 kg/mm$^2$ (52 ksi) which is too weak for applications in which the component is subject to forces associated with insertion and removal. To increase the strength of copper, a wide array of alloying elements have been added to copper. In most cases, there is a tradeoff between the increase in yield strength achieved by the alloying addition with a resultant decrease in the electrical conductivity.

Throughout this application, alloy designations such as C10200 utilize the Unified Numbering System designations. Compositional percentages are in weight percent unless otherwise noted.

For electrical and electronic applications zirconium and mixtures of zirconium and chromium are frequently added to copper. For example, copper alloy C15100 (nominal composition 0.05–0.15% zirconium and the balance copper) has an electrical conductivity of 95% IACS (IACS stands for International Annealed Copper Standard where unalloyed copper is defined as having an electrical conductivity of 100% IACS). C15100 has a spring temper yield strength of no more than 46 kg/mm$^2$ (66 ksi). A copper-zirconium intermetallic phase precipitates from the copper matrix as a discrete second phase following heat treatment (precipitation hardening) increasing the strength of the alloy. However, the yield strength of C15100 is still too low for the current trend to higher strength connectors and leadframes in miniaturized applications.

Higher strength is obtained by adding a mixture of chromium and zirconium to copper. C18100 (nominal composition 0.4%–1.0% chromium, 0.08%–0.2% zirconium, 0.03–0.06% magnesium and the balance copper) has an electrical conductivity of 80% IACS at a yield strength of from 47–50 kg/mm$^2$ (67 to 72 ksi). The electrical conductivity of C18100 is acceptable, however, the yield strength is slightly lower than desired. Also, a chromium content above the maximum solid solubility of chromium in copper, about 0.65% for a copper/-chromium binary alloy, leads to large second phase dispersions which contribute to a poor surface quality and non-uniform chemical etching characteristics.

For leadframes requiring high heat dissipation to prolong semiconductor device life and electrical connectors carrying high currents where ohmic heating is detrimental, it is desirable to have an electrical conductivity above about 70% IACS and a yield strength above about 56 kg/mm$^2$ (80 ksi).

The alloy should have good stress relaxation resistance properties both at room temperature and at elevated (up to 200° C.) service temperatures. When an external stress is applied to a metallic strip, the metal reacts by developing an equal and opposite internal stress. If the metal is held in a strained position, the internal stress will decrease as a function of both time and temperature. This phenomenon, called stress relaxation, occurs because of the replacement of elastic strain in the metal to plastic, or permanent strain, by microplastic flow. Copper based electrical connectors are frequently formed into spring contact members which must maintain above a threshold contact force on a mating member for prolonged times. Stress relaxation reduces the contact force to below the threshold leading to an open circuit. Copper alloys for electrical and electronic applications should, therefore, have high resistance to stress relaxation at both room and high ambient temperatures.

The minimum bend radius (MBR) determines how severe a bend may be formed in a metallic strip without "orange peeling" or fracture along the outside radius of the bend. The MBR is an important property of leadframes where the outer leads are bent at a 90° angle for insertion into a printed circuit board. Connectors are also formed with bends at various angles. Bend formability, MBR/t, where t is the thickness of the metal strip, is the ratio of the minimum radius of curvature of a mandrel around which the metallic strip can be bent without failure and the thickness of the metal.

$$\frac{MBR}{t} = \frac{\text{Radius of Curvature of Mandrel}}{\text{Thickness of Metal}}. \quad (1)$$

An MBR/t of under about 2.5 is desired for bends made in the "good way", bend axis perpendicular to the rolling direction of the metallic strip. An MBR of under about 2.5 is desired for bends made in the "bad way", bend axis parallel to the rolling direction of the metallic strip.

In summary, a desirable copper alloy for electrical and electronic applications would have the combination of all of the following properties:

Electrical conductivity greater than 70% IACS.

Yield strength greater than 56 kg/mm$^2$ (80 ksi).

Resistance to stress relaxation at a temperature as high as 150° C.

MBR/t less than 2.5 in the "good way" and "bad way".

The copper alloy should resist oxidation and etch uniformly. The uniform etch provides sharp and smooth vertical lead walls on etched leadframes. A uniform chemical etch during precleaning also promotes good coatings by electrolytic or electroless means.

U.S. Pat. No. 4,872,048 to Akutsu et al, discloses copper alloys for leadframes. The patent discloses copper alloys containing 0.05–1% chromium, 0.005–0.3% zirconium and either 0.001–0.05% lithium or 5–60 ppm carbon. Up to about 2% of various other additions may also be present. Two disclosed examples are Alloy 21 (0.98% chromium, 0.049% zirconium, 0.026% lithium, 0.41% nickel, 0.48% tin, 0.63% titanium, 0.03% silicon, 0.13% phosphorous, balance copper) with a tensile strength of 80 kg/mm$^2$ (114 ksi) and an electrical conductivity of 69% IACS and Alloy 75 (0.75% chromium, 0.019% zirconium, 30 ppm carbon, 0.19% cobalt, 0.22% tin, 0.69% titanium, 0.13% niobium, balance copper) with a tensile strength of 73 kg/mm$^2$ (104 ksi) and an electrical conductivity of 63% IACS.

Great Britain Patent Specification No. 1,353,430 to Gosudarstvenny Metallov, discloses copper-chromium-zirconium alloys containing tin and titanium. Alloy 1 contains 0.5% chromium, 0.13% titanium, 0.25% tin, 0.12% zirconium, balance copper with a tensile strength of 62–67 kg/mm$^2$ (88–95 ksi) and an electrical conductivity of 72% IACS.

Great Britain Patent Specification No. 1,549,107 to Olin Corporation, discloses copper-chromium-zirconium alloys containing niobium. Dependent on the method of processing, an alloy containing 0.55% chromium, 0.15% zirconium, 0.25% niobium and the balance copper has a yield stress of from 51–64 kg/mm$^2$ (73–92 ksi) and an electrical conductivity of 71–83% IACS.

SUMMARY OF THE INVENTION

It is apparent that there remains a need in the art for a copper alloy which satisfies the requirements specified above. Accordingly, it is an object of the present invention to provide such an alloy. It is a feature of the invention that the copper alloy is a copper-chromium-zirconium alloy containing specific concentrations of cobalt and titanium; iron and titanium; or cobalt, iron and titanium. Another feature of the invention is that the atomic percent ratio of cobalt to titanium; iron to titanium; or cobalt plus iron to titanium is controlled to provide high conductivity while retaining the strength of the alloy.

It is an advantage of the present invention that the claimed copper alloys have a yield strength above about 56 kg/mm$^2$ (79 ksi) and with the addition of multiple in process aging anneals, the yield strength is increased to above about 62 kg/mm$^2$ (89 ksi). Still another advantage of the invention is that the electrical conductivity of the claimed alloys is above 73% IACS and in some embodiments exceeds 77% IACS. It is a further advantage of the invention that the copper alloys exhibit excellent strength relaxation resistance with over 95% of the stress remaining after exposure to 150° C. for 3,000 hours. Yet a further advantage of the invention is that following some processing embodiments, the MBR/t of the alloy is about 1.8 in the good way and about 2.3 in the bad way for the claimed copper alloys.

Accordingly, there is provided a copper alloy consisting essentially of from an effective amount up to 0.5% by weight. chromium; from about 0.05 to about 0.25% by weight zirconium; from about 0.1 to about 1% by weight of M, where M is selected from the group consisting of cobalt, iron and mixtures thereof; from about 0.05% to about 0.5% by weight titanium; and the balance copper.

The above stated objects, features and advantages will become more apparent from the specification and drawings which follows.

DETAILED DESCRIPTION OF THE PREFERRED EMBODIMENTS

Figure 1:
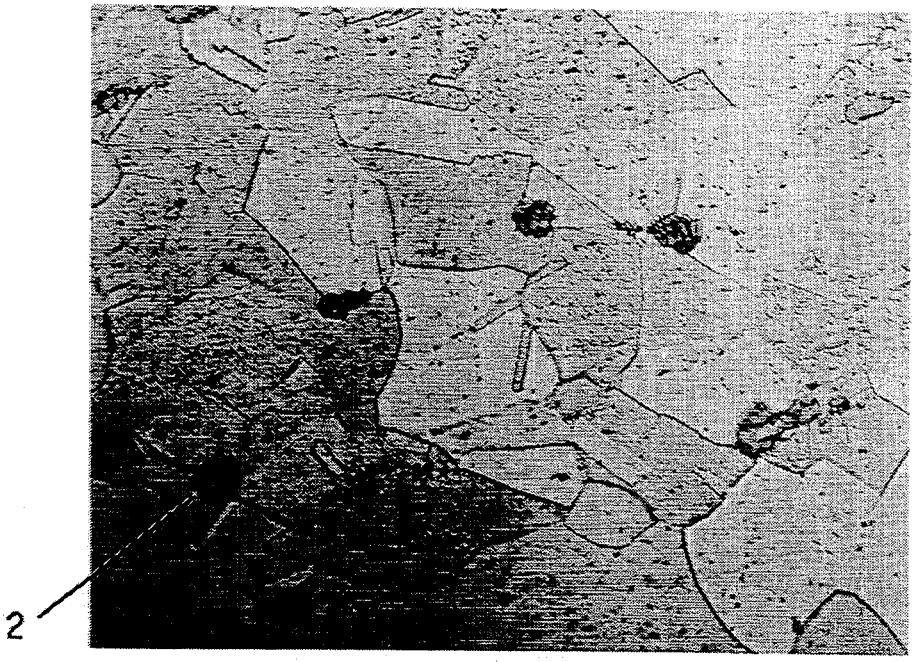
FIG. 1 is a photomicrograph of a copper base alloy containing chromium, zirconium and titanium with nickel as a transition metal addition.

The copper alloys of the invention consist essentially of chromium, zirconium, cobalt and/or iron and titanium. The chromium is present in an amount of from that effective to increase strength through precipitation hardening to about 0.8%. Zirconium is present in an amount from about 0.05% to about 0.40%. Cobalt is present in an amount from about 0.1% to about 1%. Either a portion or all of the cobalt may be substituted with an equal weight percent of iron or another transition element. Titanium is present in an amount of from about 0.05% to about 0.7%. The balance of the alloy is copper.

Chromium—Chromium is present in the alloy in an amount from that effective to increase the strength of the alloy through precipitation hardening (aging) up to about 1.0%. Preferably, the maximum chromium content is about 0.5%. As the maximum solid solubility limit of chromium in the copper alloy is approached, a coarse second phase precipitate develops. The coarse precipitate detrimentally affects both the surface quality and the etching and plating characteristics of the copper alloy without increasing the strength of the alloy.

The cobalt, iron and titanium also present in the alloy combine to form a variety of precipitates including cobalt-X or iron-X, where X is predominantly titanium but includes some chromium and zirconium. As discussed below, a portion of the Ti lattice points are usually occupied by zirconium or chromium. If excess iron, cobalt or titanium remains unreacted and in solid solution in the copper matrix, electrical conductivity is decreased. The chromium ties up additional titanium to reduce this decrease in electrical conductivity. A preferred chromium content is from about 0.1% to about 0.4% and a most preferred chromium content is from about 0.25% to about 0.35%.

Zirconium—The zirconium content is from about 0.05% to about 0.40%. A preferred maximum zirconium content is about 0.25%. If the zirconium content is too low, the alloy has poor resistance to stress relaxation. If the zirconium content is too high, coarse particles form which detrimentally affect both the surface quality and the etching characteristics of the alloy without providing any increase in strength. A preferred zirconium content is from about 0.1% to about 0.2%.

Hafnium is a suitable substitute for a portion or all of the zirconium in the same weight percentages. The extra cost associated with hafnium makes its use less desirable.

Transition Element ("M")—A transition element ("M") selected from the group consisting of cobalt, iron and mixtures thereof, is present in an amount of from about 0.1% to about 1%. While the cobalt and iron are generally interchangeable, iron provides a slight increase in strength (about a 4–5 ksi improvement) with a slight reduction in electrical conductivity (about a 5–6% IACS decrease). If the cobalt and/or iron content is too high, a coarse second phase particle forms during casting. The coarse precipitate detrimentally affects both the surface quality and the etching characteristics of the alloy. If there is insufficient titanium or chromium such that "M" remains in solid solution in the copper matrix, the electrical conductivity of the alloy is decreased. If the cobalt and/or iron content is too low, the alloy does not undergo precipitation hardening through aging and there is no corresponding increase in the strength of the alloy. A preferred amount of cobalt and/or iron is from about 0.25% to about 0.6%. The most preferred amount is from about 0.3% to about 0.5%.

Applicants believe that some or all of the cobalt and/or iron may be replaced with nickel. However, while the utility of nickel is suggested by the effect of nickel on the electrical conductivity of copper, nickel is less preferred. As shown in Table 1, nickel, when in solid solution in pure copper, has a lesser effect on the electrical conductivity of copper than either cobalt or iron. The conductivity drop from 102.6% IACS represents the drop in conductivity from the highest value presently achieved in high purity copper.

Surprisingly, when the transition metal is precipitated from the solid solution, nickel has a more detrimental effect on electrical conductivity than either cobalt or iron, as shown in Table 2. The alloys of Table 2 were processed by the steps of solutionization anneal, cold roll, age for 2 hours at 500° C. prior to measuring nominal conductivity. The alloys were overaged by heating to 500° C. for 48 hours prior to measuring the maximum conductivity.

TABLE 1

| Elemental Addition (Atomic percent) | Electrical Conductivity % IACS | Conductivity Drop from 102.6% IACS |
|---|---|---|
| 0.64 cobalt | 28.8 | −73.8 |
| 0.64 iron | 22.3 | −80.3 |
| 0.64 nickel | 71.8 | −30.8 |
| 0.64 manganese | 48.3 | −54.3 |

TABLE 2

| Alloy composition (Weight percent) | Nominal Conductivity | Maximum % IACS |
|---|---|---|
| 0.29Cr/0.19Zr/0.19Ti/0.53Co/ balance Cu | 75.2 | 85 |
| 0.29Cr/0.20Zr/0.23Ti/0.43Fe/ balance Cu | 72.0 | 78 |
| 0.31Cr/0.18Zr/0.24Ti/0.60Ni/ balance Cu | 60.4 | 72 |

Figure 2:
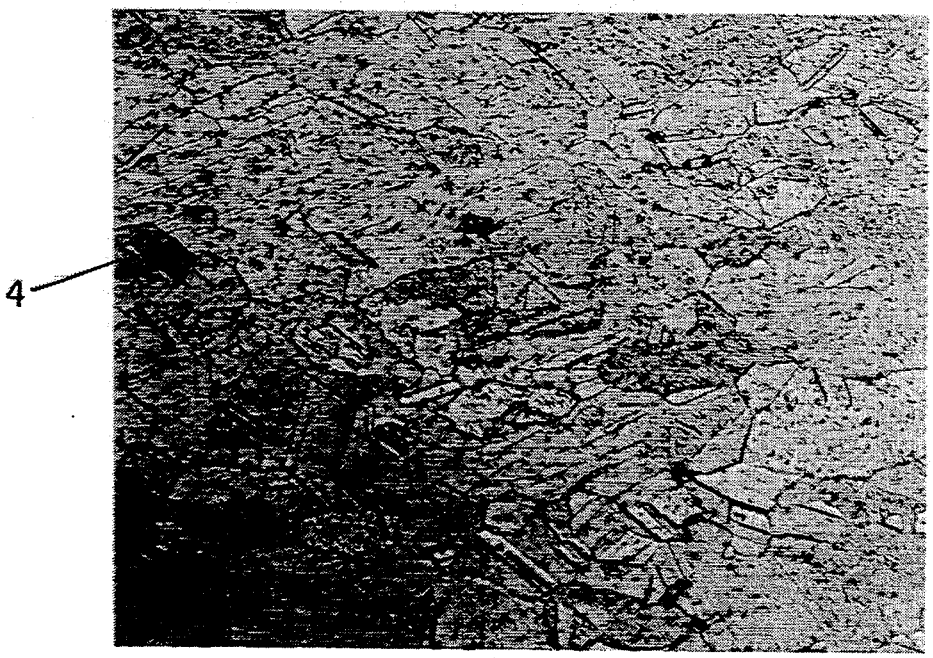
FIG. 2 is a photomicrograph of a copper base alloy containing chromium, zirconium and titanium with cobalt as a transition metal addition.

FIG. 1 is a photomicrograph at a magnification of 1000X of the nickel containing alloy of Table 2 and FIG. 2 is a photomicrograph at a magnification of 1000X of the cobalt containing alloy of Table 2. The nickel containing alloy is populated with coarse second phase precipitates. The cobalt containing alloy is essentially free of coarse second phase precipitates, containing rather, a uniform dispersion of fine particles 4. The coarse precipitate 2 is a potential crack initiation site during rolling or other working and should be avoided. Accordingly, the preferred alloys of the invention contain less than about 0.25% nickel and preferably, less than about 0.15% nickel, and most preferably less than 0.10%.

Other transition elements, such as niobium, vanadium and manganese may be used. A less reactive transition metal, such as manganese, is less preferred. Residual manganese and titanium in solid solution reduce electrical conductivity to unacceptable levels. Niobium and vanadium do not react with titanium but provide elemental dispersoids which increase strength.

Figure 3:
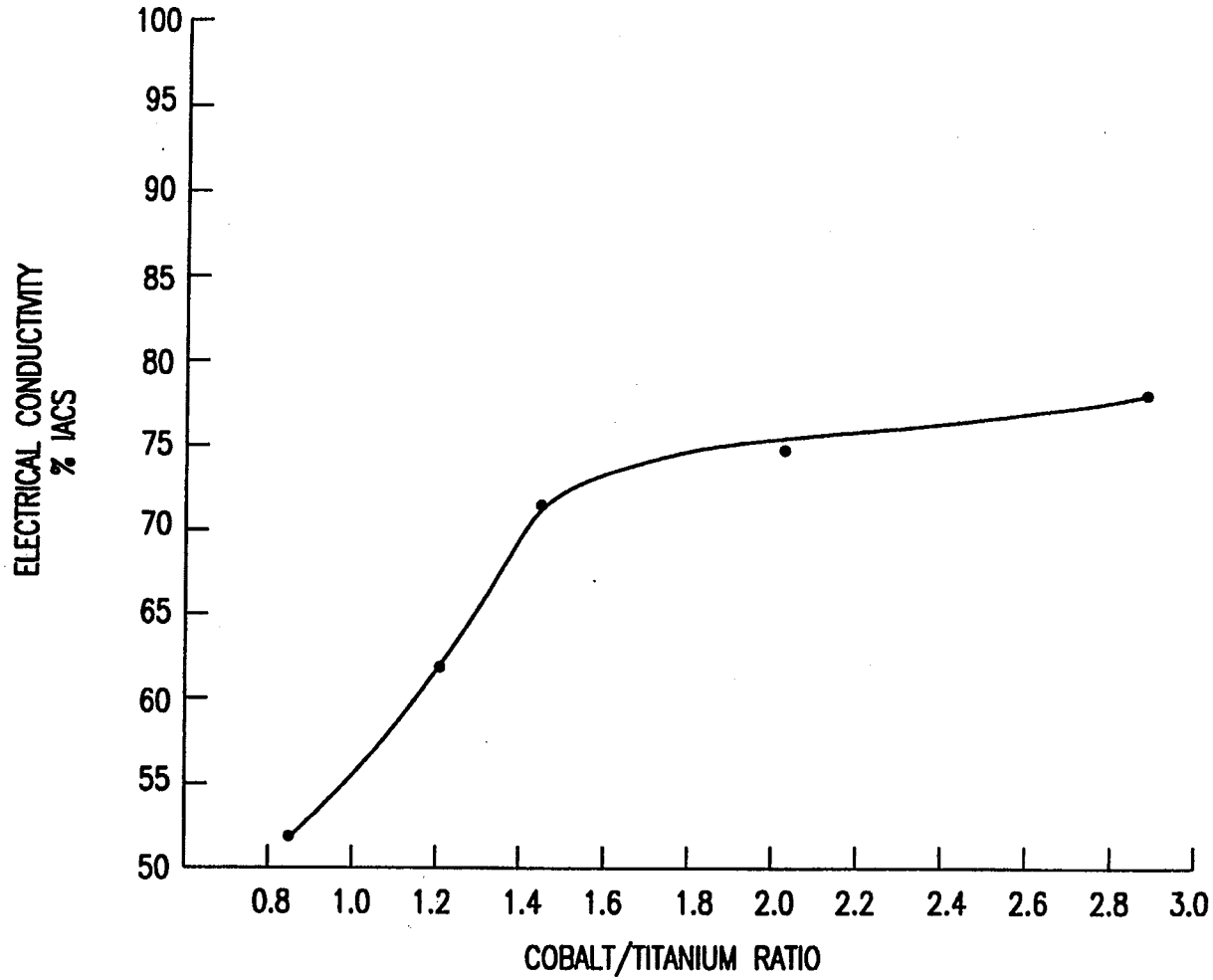
FIG. 3 graphically illustrates the effect of the cobalt-/titanium weight percent ratio on the electrical conductivity.

Titanium—Titanium is present in an amount of from about 0.05% to about 0.7%. The preferred maximum titanium content is about 0.5%. Titanium combines with "M" to form a second phase precipitate having a hexagonal crystallographic structure. The second phase is predominantly of the form CoTi or FeTi. A portion of the Ti lattice points are occupied by zirconium or chromium atoms. The preferred ratio of cobalt and/or iron to titanium is (in weight percent) from about 1.2:1 to about 7.0:1. A more preferred ratio is from about 1.4:1 to about 5.0:1 and a most preferred range is from about 1.5:1 to about 3:1. As the content of the cobalt, iron and titanium vary from the preferred ratios, the excess remains in solid solution in the copper matrix, reducing the electrical conductivity of the alloy. This effect is graphically illustrated in FIG. 3 which compares the Co/Ti ratio to electrical conductivity. The electrical conductivity decreases dramatically at a ratio of about 1.2:1 and the ratio should be maintained above that value.

Additions

The alloys of the invention may have properties tailored for specific applications by the additions of small amounts of other elements. The additions are made in an amount effective to achieve the desired property enhancement without significantly reducing desirable properties such as electrical conductivity or bend formability. The total content of these other elements is less than about 5% and preferably less than about 1%.

Magnesium may be added to improve solderability and solder adhesion. A preferred magnesium content is from about 0.05% to about 0.2%. Magnesium could also improve the stress relaxation characteristics of the alloy.

Machinability, without a significant decrease in electrical conductivity, can be enhanced by additions of sulfur, selenium, tellurium, lead or bismuth. These machinability enhancing additions form a separate phase within the alloy and do not reduce electrical conductivity. A preferred content is from about 0.05% to about 0.5%.

Deoxidizers can be added in preferred amounts of from about 0.001% to about 0.1%. Suitable deoxidizers include boron, lithium, beryllium, calcium, and rare earth metals either individually or as misch metal. Boron, which forms borides, is beneficial as it also increases the alloy strength.

Additions which increase strength, with a reduction in electrical conductivity, include aluminum and tin and may be added in an amount of up to 1%.

For a lower cost alloy, up to 20% of the copper may be replaced with zinc. The zinc diluent reduces cost and provides the alloy with a yellow color. A preferred zinc content is from about 5% to about 15%.

Figure 5:
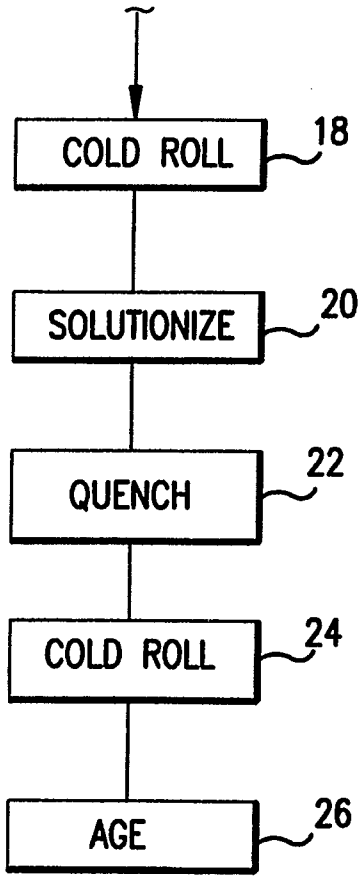
FIG. 5 shows in block diagram a first embodiment to further process the copper alloy for high strength and high electrical conductivity.
Figure 4:
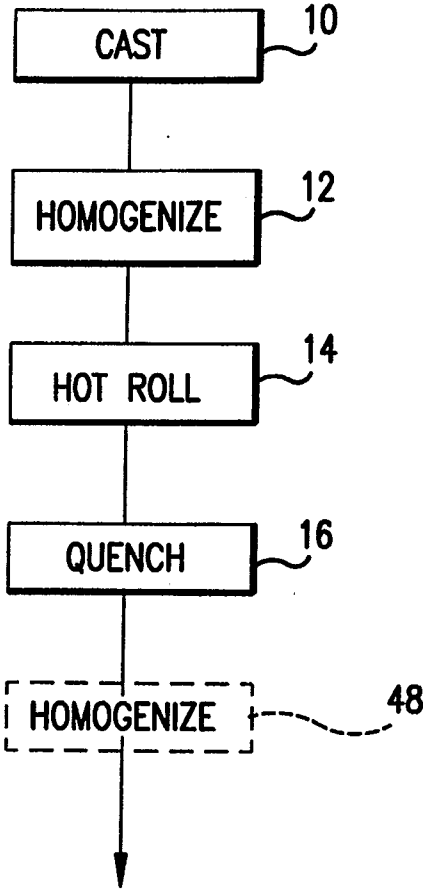
FIG. 4 shows in block diagram the initial processing of a copper alloy containing chromium, zirconium, cobalt and/or iron, and titanium in accordance with the invention.
Figure 6:
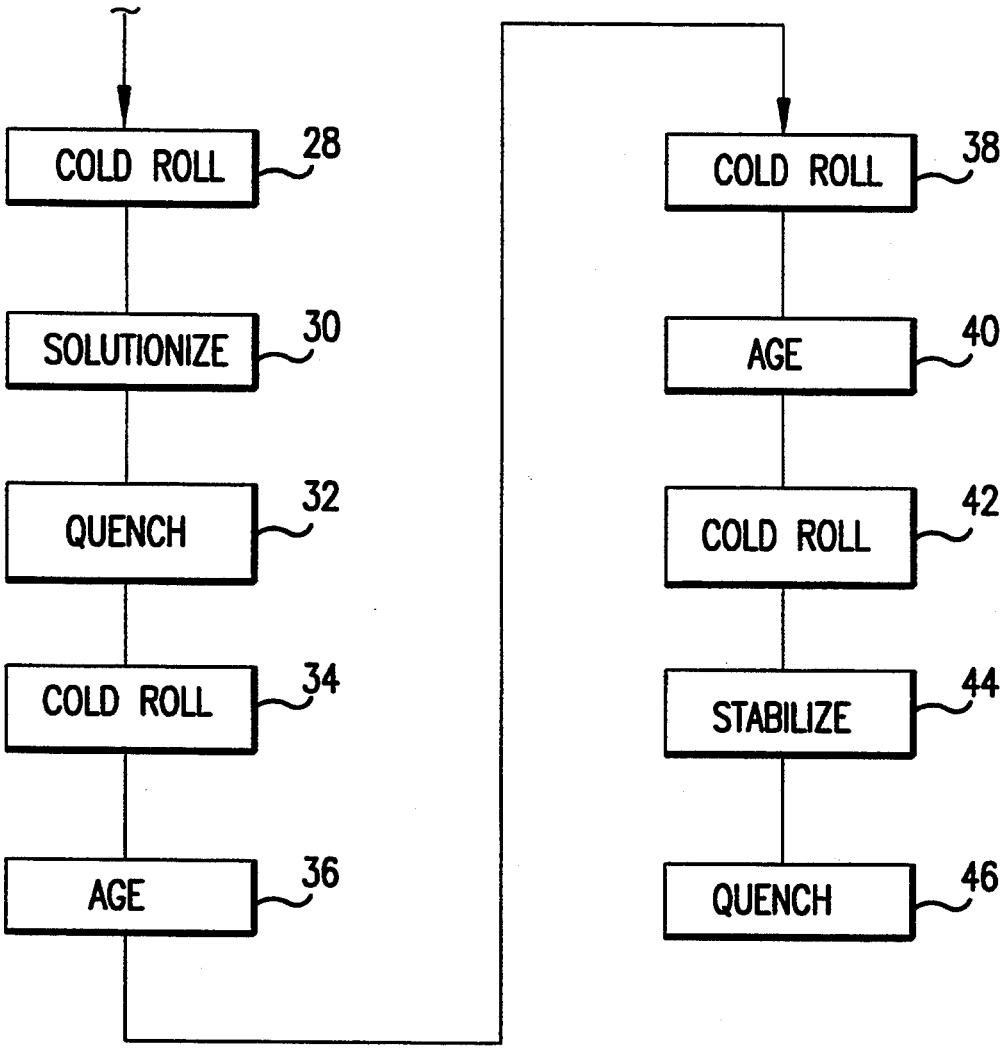
FIG. 6 shows in block diagram a second embodiment to further process the copper alloy with extra high strength with a minimal loss of electrical conductivity.

The alloys of the invention are formed by any suitable process. Two preferred methods are illustrated in FIGS. 4–6. FIG. 4 illustrates in block diagram the process steps generic to both preferred methods. FIG. 5 illustrates subsequent processing steps to produce an alloy having both high strength and high electrical conductivity. FIG. 6 illustrates in block diagram alternative processing steps to produce an alloy having even higher strength, with a minimal sacrifice in electrical conductivity.

With reference to FIG. 4, the alloys are cast 10 by any suitable process. In one exemplary process; cathode copper is melted in a silica crucible under a protective charcoal cover. The desired amount of cobalt and/or iron is then added. Titanium is added next to the melt, followed by chromium and zirconium. The melt is then poured into a steel mold and cast into an ingot.

The ingots are then heated prior to rolling 12 to a temperature generally between about 850° C. and 1050° C. for from about 30 minutes to about 24 hours which also at least partially homogenizes the alloy. Preferably, heating is to about 900° C.–950° C. for about 2–3 hours.

Alternatively, the ingot is cast directly into a thin slab, known in the art as "strip casting". The slab has a thickness of from about 2.5 mm to about 25 mm (0.1–1 inch). The cast strip is then either cold rolled or treated by a post casting recrystallization/homogenization anneal and then cold rolled.

Following homogenization 12, the ingot is hot rolled 14 to a reduction in excess of about 50% and preferably to a reduction on the order of from about 75% to about 95%. Throughout this application, reductions by rolling are given as reductions in cross sectional area unless otherwise specified. The hot roll reduction 14 may be in a single pass or require multiple passes. Immediately following the last hot roll reduction 14, the ingot is rapidly cooled to below the aging temperature, typically by quenching 16 in water to room temperature to retain the alloying elements in solid solution. Each of the quench steps specified in Applicants' processes are preferred, but optional, each quench step may be replaced with any other means of rapid cooling known in the art.

Following quenching 16, two different sequences of processing steps result in alloys with slightly different properties. A first process (designated "Process 1") is illustrated in FIG. 5. The alloy achieves high strength and high electrical conductivity. A second process (designated "Process 2") achieves higher strength with a minimal sacrifice of electrical conductivity.

FIG. 5 illustrates Process 1. The alloy is cold rolled 18 to reduction in excess of about 25% and preferably to a reduction of from about 60% to about 90%. The cold roll 18 may be a single pass or multiple passes with or without intermediate recrystallization anneals. Following the cold roll 18, the alloy is solutionized 20 by heating to a temperature from about 750° C. to about 1050° C. for from about 30 seconds to about 2 hours. Preferably, the solutionization 20 is at a temperature of from about 900° C. to about 925° C. for from about 30 seconds to 2 minutes.

The alloy is next quenched 22 and then cold rolled 24 to final gauge. The cold roll 24 is a reduction in excess of about 25% and preferably in the range of from about 60% to about 90%. The cold roll 24 may be a single pass or in multiple passes with or without intermediate recrystallization anneals.

After the alloy is reduced to final gauge by cold roll 24, the alloy strength is increased by a precipitation aging 26. The alloy is aged by heating to a temperature of from about 350° C. to about 600° C. for from about 15 minutes to about 16 hours. Preferably, the alloy is heated to a temperature of from about 425° C. to about 525° C. for from about 1 to about 8 hours. Process 1 is utilized when the optimum combination of strength, electrical conductivity, and formability is required.

If higher strength is required, at a slight reduction in electrical conductivity, Process 2 as illustrated in FIG. 6 is utilized. Following the quench 16 (FIG. 4), the alloy is cold rolled 28 to solutionizing gauge. The cold roll reduction is in excess of about 25% and preferably in the range of from about 60% to about 90%. The cold roll step 28 may be a single pass or multiple passes with or without intermediate recrystallization anneals.

Following cold rolling 28, the alloy is solutionized 30 by heating to a temperature of from about 750° C. to about 1050° C. for from about 15 seconds to about 2 hours. More preferably, the solutionizing temperature is from about 900° C. to about 925° C. for from about 30 seconds to about 2 minutes. Following solutionizing 30, the alloy is rapidly cooled such as by quenching 32, typically in water, to below the aging temperature.

The alloy is then cold rolled 34 to a reduction of from about 25% to about 50%. The reduction may be a single pass or multiple passes with intermediate solutionizing recrystallization anneals. Following the cold roll 34, the alloy is age hardened 36 at temperatures sufficiently low to avoid recrystallization. The aging 36 is preferably at a temperature of from about 350° C. to about 600° C. for a time of from about 15 minutes to about 8 hours. More preferably, the non-recrystallizing precipitation hardening treatment 36 is at a temperature of from about 450° C. to about 500° C. for from about 2 to about 3 hours.

Following the non-recrystallizing aging 36, the alloy is cold rolled 38 to a reduction of from about 30% to about 60%. Following the cold roll step 38, the alloy is optionally given a second non-recrystallizing precipitation hardening anneal 40 at a temperature in the range of from about 350° C. to about 600° C. for from about 30 minutes to about 5 hours. Preferably, this optional second non-recrystallizing precipitation hardening anneal 40 is at a temperature of from about 450° C. to about 500° C. for from about 2 to 4 hours. The precise time and temperature for the second optional non-recrystallizing precipitation hardening step 40 is selected to maximize the electrical conductivity of the alloy.

The alloy is then cold rolled 42 by from about 35% to about 65% reduction to final gauge in single or multiple passes, with or without intermediate sub-recrystallization anneals. Following the cold roll 42, the alloy is given a stabilization relief anneal 44 at a temperature of from about 300° C. to about 600° C. for from about 10 seconds to about 10 minutes for a strand anneal. For a bell anneal, the stabilization relief anneal 44 is at a temperature of up to about 400° C. for from about 15 minutes to about 8 hours. More preferred is a bell anneal at about 250° C. to about 400° C. for from about 1 to about 2 hours. Following the stabilization anneal 44, the alloy is quenched 46 if strand annealed. A quench is generally not utilized following a bell anneal. Process 2 produces an alloy having maximum strength with a minimal sacrifice in electrical conductivity.

In another process embodiment, a homogenization anneal (reference numeral 48 in FIG. 4) is included with either Process 1 or Process 2. The homogenization anneal 48 is inserted between the hot roll step 14 and the solutionizing step (20 in FIG. 5 or 30 in FIG. 6), before or after the cold roll step (18 in FIG. 5 or 28 in FIG. 6). The homogenization anneal 48 is at a temperature of from about 350° C. to about 750° C. for from about 15 minutes to about 8 hours. Preferably, the homogenization anneal 48 is at a temperature of from about 550° C. to about 650° C. for from about 6 to about 8 hours.

Generally, the alloys made by Process 1 are utilized where high strength, high electrical conductivity and formability are required such as in connector and leadframe applications. Process 2 is utilized in applications where higher strength and excellent stress relaxation resistance are required and some minimal loss in electrical conductivity is tolerated, for example, electrical connectors subject to elevated temperature such as for automotive applications as well as leadframes requiring high strength leads.

The advantages of the alloys of the invention will be apparent from the Examples which follow. The Examples are intended to be exemplary and not to limit the scope of the invention.

EXAMPLES

The electrical and mechanical properties of the alloys of the invention were compared with copper alloys conventionally used in leadframe and connector applications. Table 3 lists the alloy compositions. The alloys preceded by an asterisk, H, I and P are alloys of the invention while other alloys are either conventional alloys or, as to alloys G, K and L, variations of preferred compositions to illustrate either the contribution of chromium or the ratio of "M" to titanium.

TABLE 3

| | Alloy Composition | | | | | | |
|---|---|---|---|---|---|---|---|
| Alloy | Zr | Cr | Co | Fe | Ti | Mg | Other |
| A | 0.13 | 0.80 | — | — | — | 0.08 | |
| B | 0.20 | 0.32 | — | — | — | 0.06 | |
| C | 0.25 | — | — | — | — | — | |
| D | 0.25 | 0.27 | 0.23 | — | — | — | |
| E | 0.21 | 0.25 | — | 0.32 | — | — | |
| F | 0.21 | 0.32 | — | — | 0.21 | — | |
| G | 0.21 | — | — | 0.43 | 0.23 | — | |
| *H | 0.20 | 0.30 | 0.46 | — | 0.24 | — | |
| *I | 0.20 | 0.29 | — | 0.43 | 0.23 | — | |
| J | 0.20 | 0.26 | 0.25 | 0.27 | 0.22 | — | |
| K | 0.20 | 0.35 | 0.28 | — | 0.24 | — | |
| L | 0.20 | 0.37 | — | 0.24 | 0.24 | — | |
| M | 0.19 | — | 0.66 | — | 0.23 | — | |
| N | — | — | — | 0.6 | — | 0.05 | 0.18 P |
| O | — | 0.3 | — | — | 0.1 | — | 0.02 Si |
| *P | 0.20 | 0.3 | 0.5 | — | 0.2 | — | |
| Q | 0.10 | — | — | — | — | — | |
| R | 0.25 | 0.27 | 0.23 | — | — | — | |

Alloys A through M and P were produced by the method described above. A 5.2 kg (10 pound) ingot of each alloy was made by melting cathode copper in a silica crucible under a protective charcoal cover, charging the required cobalt and/or iron additions, then adding the chromium and titanium addition followed by zirconium and magnesium as required for the particular alloy. Each melt was then poured into a steel mold which upon solidification produced an ingot having a thickness of 4.45 cm (1.75 inches) and a length and width both 10.16 cm (4 inches). Alloys N and O are commercial alloys acquired as strip having an H08 (spring) temper. Alloy Q is alloy C15100 acquired as commercially produced strip in a HR04 (hard relief anneal) temper.

Table 4 shows the electrical and mechanical properties of alloys A through M and R processed by Process 1. Alloys H, I and J have a higher strength than base line copper zirconium alloys (alloy C) as well as base line copper chromium zirconium alloys (alloy B). Surprisingly, alloys H, I and J which have about 0.30 weight percent chromium have a yield strength and ultimate tensile strength about equal to alloy A which has a chromium content almost three times as high.

The effect of chromium on enhancing conductivity is illustrated by comparing alloy G and alloy I. The only significant difference in composition between the alloys is the presence in alloy I of 0.29% chromium. The electrical conductivity of alloy I, 72.0% IACS, is significantly higher than the conductivity of alloy G 65.1% IACS.

The criticality of the weight ratio of 2:1 for the (cobalt and/or iron):titanium is demonstrated by comparing alloys H and I which have the ratio of 2:1 to alloys K and L which have a ratio of about 1:1. While the strengths of alloys H and I and alloys K and L are approximately equal, the electrical conductivity of alloys K and L are about 20% IACS lower.

TABLE 4

| | Properties of Alloys Processed According to Process 1 | | | | | | |
|---|---|---|---|---|---|---|---|
| | Conductivity | Yield Strength | | Ultimate Tensile Strength | | Elongation | MBR/t |
| Alloy | % IACS | kg/mm² | ksi | kg/mm² | ksi | percent | (GW/BW) |
| A | 79.0 | 56.7 | 81 | 58.8 | 84 | 9 | 1.7/1.7 |
| B | 77.6 | 52.5 | 75 | 55.3 | 79 | 8 | 1.4/2.3 |
| C | 91.3 | 44.1 | 63 | 46.9 | 67 | 8 | 1.4/1.8 |
| D | 74.7 | 54.6 | 78 | 56.0 | 80 | 8 | 1.4/1.8 |
| E | 62.7 | 52.5 | 75 | 54.6 | 78 | 9 | 2.3/3.1 |
| F | 36.0 | 57.4 | 82 | 60.2 | 86 | 9 | 1.8/3.1 |
| G | 65.1 | 57.4 | 82 | 60.9 | 87 | 10 | 1.8/2.3 |
| *H | 77.5 | 57.4 | 82 | 60.2 | 86 | 8 | 1.8/2.3 |
| *I | 72.0 | 58.1 | 83 | 60.9 | 87 | 9 | 1.8/2.3 |
| J | 73.3 | 55.3 | 79 | 59.5 | 85 | 9 | 1.5/1.8 |
| K | 52.4 | 58.8 | 84 | 60.9 | 87 | 9 | 2.3/2.3 |
| L | 56.6 | 62.3 | 89 | 64.4 | 92 | 10 | 2.3/2.3 |
| M | 70.7 | 49.0 | 70 | 51.1 | 73 | 8 | 1.8/2.3 |
| R | 82.0 | 51.1 | 73 | 53.2 | 76 | 9 | 1.4/1.8 |

Alloys D and R illustrates that for certain applications, the titanium may be eliminated. The copper-chromium-zirconium-cobalt alloys have strengths equal to alloys containing significantly higher chromium with better formability, etching and plating characteristics. The electrical conductivity is higher than that of titanium containing alloys but at a loss of strength. It is believed that the chromium, zirconium and cobalt ranges would be the same as that of the other alloys of the invention.

Table 5 illustrates the properties of alloys A through E, G through J and R when processed by Process 2. The one exception is alloy C which was processed with a single in process aging anneal. Alloy C was cold rolled to 2.54 mm (0.10 inch) gauge from milled hot rolled plate (16 of FIG. 1) solutionized at 900° C. for 30 seconds and then water quenched. The alloy was then cold rolled to a 50% reduction, aged at 450° C. for 7 hours and then cold rolled with a 50% reduction to a final gauge of 0.64 mm (0.025 inch). Alloy C was then relief annealed at 350° C. for 5 minutes.

The alloys of the invention, H, I and J, all have higher strength than the conventional alloys, including commercial alloy C181 (alloy A) which has a chromium content almost three times that of the alloys of the invention. In addition, the significant increase in strength, an increase of 5.6–8.4 kg/mm$^2$ (8–12 ksi) for the yield strength, is accompanying by almost no drop in electrical conductivity.

Process 2 results in alloys of the invention with an about 21 kg/mm$^2$ (30 ksi) yield strength improvement over binary copper zirconium alloys such as alloy C. The benefit of the chromium addition is apparent by comparing the electrical conductivity of alloy G (0% Cr) with that for alloy I (0.29% Cr). Alloy G has a conductivity of 59.3% IACS alloy I has a conductivity of 75.5% IACS.

TABLE 4

Properties of Alloys Processed According to Process 2

| Alloy | Conductivity % IACS | Yield Strength kg/mm$^2$ | Yield Strength ksi | Ultimate Tensile Strength kg/mm$^2$ | Ultimate Tensile Strength ksi | Elongation percent | (GW/BW) MBR/t |
|---|---|---|---|---|---|---|---|
| A | 81.0 | 56.7 | 81 | 57.4 | 82 | 7 | 2.2/2.4 |
| B | 82.8 | 50.4 | 72 | 51.8 | 74 | 4 | 2.1/2.9 |
| C | 94.4 | 43.4 | 62 | 44.8 | 64 | 3 | 1.9/3.1 |
| D | 80.5 | 54.6 | 78 | 56.0 | 80 | 4 | 2.4/3.8 |
| E | 70.6 | 53.9 | 77 | 55.3 | 79 | 3 | 2.8/5.2 |
| G | 59.3 | 62.3 | 89 | 64.4 | 92 | 3 | 2.4/5.0 |
| *H | 77.1 | 65.1 | 93 | 68.6 | 98 | 3 | 2.8/5.2 |
| *I | 75.5 | 64.4 | 92 | 65.8 | 94 | 5 | 3.0/5.2 |
| J | 73.7 | 62.3 | 89 | 65.8 | 94 | 5 | 2.3/5.2 |
| R | 80.5 | 54.6 | 78 | 56.0 | 80 | 4 | 2.4/3.8 |

TABLE 6

Stress Relaxation - 150° C. Exposure

| Alloy | Process Method | Yield Strength kg/mm$^2$ | Yield Strength ksi | Percent Stress Remaining After 3000 hours |
|---|---|---|---|---|
| A | AGED | 56.7 | 81 | 92 |
| A | 2-IPA | 56.7 | 81 | 87 |
| C | AGED | 44.1 | 63 | 89 |
| C | 1-IPA | 43.4 | 62 | 84 |
| D | AGED | 54.6 | 78 | 92 |
| E | AGED | 52.5 | 75 | 96 |
| *H | AGED | 57.4 | 82 | 95 |

TABLE 6-continued

Stress Relaxation - 150° C. Exposure

| Alloy | Process Method | Yield Strength kg/mm$^2$ | Yield Strength ksi | Percent Stress Remaining After 3000 hours |
|---|---|---|---|---|
| *H | 2-IPA | 65.1 | 93 | 85 |
| *I | AGED | 58.1 | 83 | 96 |
| *I | 2-IPA | 58.1 | 83 | 96 |
| J | 2-IPA | 63.0 | 90 | 96 |
| Q | HD/RA | 39.2 | 56 | 80 |

TABLE 7

Comparison of Leadframe Alloys

| Alloy | Conductivity % IACS | Yield Strength kg/mm$^2$ | Yield Strength ksi | MBR/t GW/BW | % Stress Remaining 105° C. 10 Years | % Stress Remaining 125° C. - 3000 hours |
|---|---|---|---|---|---|---|
| N | 77 | 49 | 70 | 2.0/2.5 | 78 | 75 |
| O | 75 | 49 | 70 | 1.5/2.5 | 82 | 84 |
| *P | 75 | 57.4 | 82 | 1.8/2.3 | 95 | 92 |

Table 6 shows the stress relaxation of the alloys of the invention is better than that of either binary copper-zirconium alloys (alloys C and Q) or ternary copper-zirconium-chromium alloys (alloy A). In the second column of Table 6, "process type":

Aged=processing according to Process 1.

2-IPA=processing according to Process 2, with 2 In Process Anneals.

1-IPA=processing according to Process 2 with the second precipitation hardening anneal (40 in FIG. 3) deleted, 1 In Process Anneal.

One application for which the alloys of the invention are particularly suited is a leadframe for an electronic package as shown in Table 7. Alloys N and O represent alloys conventionally used in electronic packaging applications. Alloy N is copper alloy C197 and alloy O is C18070, a commercially available leadframe alloy. The alloy of the invention, alloy P, has a conductivity equivalent to those of the conventional leadframe alloys. The alloy P yield strength is considerably higher than that of alloys N and O. The minimum bend radius is less for alloy P and the resistance to stress relaxation is significantly improved.

While the alloys of the invention have particular utility for electrical and electronic applications such as electrical connectors and leadframes, the alloys may be used for any application in which high strength and/or good electrical conductivity is required. Such applications include conductive rods, wires and buss bars. Other applications include those requiring high electrical conductivity and resistance to stress relaxation such as welding electrodes.

The patents cited herein are intended to be incorporated by reference in their entireties.

It is apparent that there has been provided in accordance with this invention a copper alloy characterized by high strength and high electrical conductivity which is particularly suited for electric and electronic applications which fully satisfies the objects, means and advantages set forth hereinbefore. While the invention has been described in combination with specific embodiments and examples thereof, it is evident that may alternatives, modifications and variations will be apparent to those skilled in the art in light of the foregoing description. Accordingly, it intended to embrace all such alternatives, modifications and variations as fall within the spirit and broad scope of the appended claims.

We claim:

1. A copper alloy, consisting essentially of:

an effective amount to increase strength up to about 1.0 weight percent chromium;

from about 0.05 to about 0.40 weight percent zirconium, hafnium or a mixture thereof;

from about 0.1 to about 1.0 weight percent of "M" where "M" is selected from the group consisting of cobalt, iron, nickel and mixtures thereof with a maximum nickel content of about 0.25 weight percent; and from about 0.05 to about 0.7 weight percent titanium where the atomic ratio of "M" to titanium, M:Ti, is from about 1.2:1 to about 7.0:1.

2. The copper alloy of claim 1 wherein said alloy further contains up to 5 weight percent of one or more additions selected from the group niobium, vanadium, manganese, magnesium, sulfur, selenium, tellurium, lead, bismuth, lithium, beryllium, calcium, boron, aluminum, tin and rare earth metals, individually or as misch metal.

3. The copper alloy of claim 2 wherein said addition is from about 0.05 to about 0.2 weight percent magnesium.

4. The copper alloy of claim 2 wherein ratio of "M" to titanium is from about 1.4:1 to about 5.0:1.

5. A copper alloy, consisting essentially:

an effective amount to increase strength up to about 1.0 weight percent chromium;

from about 0.05 to about 0.40 weight percent zirconium, hafnium or a mixture thereof;

from about 0.1 to about 1.0 weight percent of "M" where "M" is selected from the group consisting of cobalt, iron, nickel, and mixtures thereof, with the total nickel content of less than about 0.15 weight percent; and from about 0.05 to about 0.5 weight percent titanium.

6. The copper alloy of claim 5 wherein "M" is selected from the group consisting of cobalt, iron and mixtures thereof.

7. The copper alloy of claim 6 wherein said alloy further contains up to 5 weight percent of one or more additions selected from the group niobium, vanadium, manganese, magnesium, sulfur, selenium, tellurium, lead, bismuth, lithium, beryllium, calcium, boron, aluminum, tin and rare earth metals either individually or as misch metal.

8. The copper alloy of claim 7 wherein the ratio of "M" to titanium, M:Ti, is from about 1.2:1 to about 7.0:1.

9. A copper alloy, consisting essentially of:

an effective amount to increase strength to about 0.5 weight percent chromium;

from about 0.05 to about 0.40 weight percent zirconium, hafnium or a mixture thereof; and from about 0.25 to about 0.6 weight percent of "M" where "M" is selected from the group consisting of cobalt, iron, nickel, and mixtures thereof, where the total nickel content is less than about 0.15 weight percent.

10. The copper alloy of claim 9 wherein said alloy further contains up to 5 weight percent of one or more additions selected from the group niobium, vanadium, manganese, magnesium, sulfur, selenium, tellurium, lead, bismuth, lithium, beryllium, calcium, boron, aluminum, tin and rare earth metals either individually or as misch metal.

11. The copper alloy of claim 10 wherein said addition is from about 0.05 to about 0.2 weight percent magnesium.

12. The copper alloy of claim 10 wherein "M" is selected from the group consisting of cobalt, iron and mixtures thereof.

13. The copper alloy of claim 11 wherein said chromium content is from about 0.1 to about 0.4 weight percent.

14. The copper alloy of claim 12 wherein said zirconium content is from about 0.05 to about 0.25 weight percent.

15. The alloy of claim 2 further containing up to 20% by weight zinc.

16. The alloy of claim 7 further containing up to 20% by weight zinc.

17. The alloy of claim 10 further containing up to 20% by weight zinc.

18. A leadframe manufactured from the alloy of claim 1.

19. An electrical connector manufactured from the alloy of claim 1.

20. A wire manufactured from the alloy of claim 1.

* * * * *

UNITED STATES PATENT AND TRADEMARK OFFICE

CERTIFICATE OF CORRECTION

PATENT NO. : 5,370,840

DATED : December 6, 1994

INVENTOR(S) : Caron et al

It is certified that error appears in the above-indentified patent and that said Letters Patent is hereby corrected as shown below:

The errors appear at column 13, line 31, column 13, line 54 and column 14, line 23.

1. A copper alloy, consisting essentially of:
an effective amount to increase strength up to about 1.0 weight percent chromium;
from about 0.05 to about 0.40 weight percent zirconium, hafnium or a mixture thereof;
from about 0.1 to about 1.0 weight percent of "M" where "M" is selected from the group consisting of cobalt, iron, nickel and mixtures thereof with a maximum nickel content of about 0.25 weight percent; [and]
from about 0.05 to about 0.7 weight percent titanium where the atomic ratio of "M" to titanium, M:Ti, is from about 1.2:1 to about 7.0:1; and
the balance copper.

5. A copper alloy, consisting essentially of:
an effective amount to increase strength up to about 1.0 weight percent chromium;
from about 0.05 to about 0.40 weight percent zirconium, hafnium or a mixture thereof;
from about 0.1 to about 1.0 weight percent of "M" where "M" is selected from the group consisting of cobalt, iron, nickel and mixtures thereof, with the total nickel content of less than about 0.15 weight percent; [and]
from about 0.05 to about 0.5 weight percent titanium; and
the balance copper.

UNITED STATES PATENT AND TRADEMARK OFFICE

CERTIFICATE OF CORRECTION

PATENT NO. : 5,370,840

DATED : December 6, 1994

INVENTOR(S) : Caron et al

It is certified that error appears in the above-indentified patent and that said Letters Patent is hereby corrected as shown below:

9. A copper alloy, consisting essentially of:

an effective amount to increase strength to about 0.5 weight percent chromium;

from about 0.05 to about 0.40 weight percent zirconium, hafnium or a mixture thereof; [and]

from about 0.25 to about 0.6 weight percent of "M" where "M" is selected from the group consisting of cobalt, iron, nickel, and mixtures thereof, where the total nickel content is less than about 0.15 weight percent; and the balance copper.

Signed and Sealed this

Twenty-fifth Day of July, 1995

Bruce Lehman

BRUCE LEHMAN

*Commissioner of Patents and Trademarks*

*Attest:*

*Attesting Officer*